United States Patent [19]

Tilse

[11] Patent Number: 4,907,988

[45] Date of Patent: Mar. 13, 1990

[54] CONTACT PIN

[75] Inventor: Wilhelm Tilse, Birkenfeld, Fed. Rep. of Germany

[73] Assignee: Inovan G.m.b.H. & Co. KG, Metalle und Bauelemente, Birkenfeld, Fed. Rep. of Germany

[21] Appl. No.: 322,166

[22] Filed: Mar. 13, 1989

[30] Foreign Application Priority Data

Mar. 15, 1988 [EP] European Pat. Off. ..... 88104048.9

[51] Int. Cl.[4] ..... H01R 13/42

[52] U.S. Cl. ..... 439/751; 439/84

[58] Field of Search ..... 439/82, 84, 751

[56] References Cited

U.S. PATENT DOCUMENTS 4,415,220 11/1983 Kant ..... 439/751

4,746,301 5/1988 Key ..... 439/751 X

*Primary Examiner*—Eugene F. Desmond

[57] ABSTRACT

In a contact pin for insertion into metal-coated bores in a contact panel which pin includes a leading guide section followed by a contact section and a connecting section the contact section is S-shaped in cross-section providing for spring arms with contact surface areas at their radial outer ends which have a relatively large even resiliency over the full length of the contact section thereby providing for good but never excessive contact pressure of the contact surfaces on the spring arms with the walls of the bores into which the contact pins are inserted and furthermore avoiding damage to the contact metal coatings upon insertion of the pin into a bore.

7 Claims, 3 Drawing Sheets

Fig. 1

CONTACT PIN

BACKGROUND OF THE INVENTION

The present invention relates to contact pins adapted to be inserted into metal-coated bores of circuit boards which contact pins include guide sections and successive contact and connecting sections.

Electrical connections with certain points of circuit boards or contact panels are often established by the insertion of contact pins directly into metal-coated bores in the contact panels. For various reasons, mainly however because the electrical connections are usually established by automatic manufacturing equipment, the contact pins have guide sections at their front ends, which guide sections are somewhat smaller in cross-section than the metal-coated bores of the contact panels so that insertion of the pins into the bores is facilitated and the contact pins are automatically centered during insertion into the bores. Axially adjacent the guide section there is provided the contact section which is that part of a contact pin which provides for good electrical contact with the metal layer on the inner walls of the bores. The metal layer or coating is relatively thin; it has generally a thickness of several $\mu$, up to 1/100 mm in exceptional cases. As a result of manufacturing methods however the tolerances for the bore diameter are relatively large; they may be in the area of 2/10 mm.

In spite of such large tolerances in bore diameters the contact surfaces of the contact pins should be in contact with the metallic inner surfaces of the bores with a predetermined minimum contact pressure and this minimum pressure should be maintained as long as the pins are disposed in the bores.

It is further desirable that, upon insertion of the pins into the bores, any contact surface oxidation layer or any other surface deposits including gas molecules are removed so that, after insertion of the contact pins, there is full metallic contact established between the contact surfaces of the pins and the inner metallic surfaces of the bores. In spite of these requirements the thin metallic contact layers on the inner surfaces of the bores must not be damaged. Damage to those contact layers would not only cause admission of gases resulting in a slow oxidation of the contact surfaces but might even, upon removal of a contact pin and insertion of a new pin, adversely affect the possibility for the new pin to make good contact.

Prior art contact pins are generally provided with axial slots so that the remaining outwardly bent web structures can be resiliently compressed in order to achieve the resilient engagement of the pin contact surfaces with the metal-coated bore walls.

These kinds of contact pins generally engage the contact surfaces of the bores in the desired manner once they are disposed in the bores but they usually damage the metal layers on the inner surfaces of the bores since, although the resiliency of the web structures is adequate in the axial centers of the webs, there is insufficient resiliency at the end portions of the webs. These relatively rigid ends of the webs damage the thin metal layers of the bores upon insertion of the pins if the contact pins are only slightly oversized or the bores are slightly undersized.

The same undesirable results are achieved with other known contact pins such as V-shaped or W-shaped pins.

All these contact pins have the disadvantage that they are not sufficiently resilient in the interface areas between the guide sections and the contact sections such that the metal coatings of the bores are generally damaged if the pins are slightly oversized or the holes are slightly undersized. If, on the other hand, the pins are slightly undersized or the holes are slightly oversized, the contact pin engagement with the contact surfaces of the bores is usually insufficient.

The reason for the rigidity of the webs at the interface area of guide and contact sections is that these areas are the origins of the web structures such that the lever length of the springs is very small or practically zero and, as a result, the resiliency of the web structures is zero at this point where the contact structures first come into contact with the thin metal layers of the contact bores.

It is the principal object of the present invention to provide a contact pin which fulfills all the requirements pointed out earlier and which will not damage the contact metal layers of the bores into which the pin is inserted whether or not the pins or bores are under or over size as long as they are within certain tolerance limits.

SUMMARY OF THE INVENTION

A contact pin for insertion into metal-coated bores in a contact panel or circuit board includes a leading guide section to facilitate insertion of the pin followed by an adjacent contact section and finally a connecting section. The contact section is S-shaped in cross-section providing spring arms with contact surface areas at their radial outer ends which spring arms have a relatively large resiliency which is essentially the same over the full axial length of the contact section thereby providing for good but never excessive contact pressure for the engagement of the contact surfaces on the spring arms with the coated walls of the bores.

The contact sections are formed by first flattening the contact section of the pin to an oblong cross-section having radially projecting flat arms which arms are then stamped so as to be bent into the S-shaped structures.

With this simple arrangement the transition areas between the guide sections and the contact sections of the contact pins are fully resilient since the spring arms carrying the contact areas are of constant length over the full extent of the contact section, that is, the S-shaped spring arms are essentially equal to the bore diameter. Appropriate spring forces for the contact structures are therefore provided in the center of the contact structure for good contact between the contact surfaces and sufficiently low spring forces are provided for the contact structures in the critical transition areas of the contact pins to prevent damage to the contact metal layers in the contact bores. Still smoother and softer insertion of the pins can be achieved if in accordance with a preferred embodiment of the invention the vertices at the inner surfaces of the S-shaped contact arms of the contact pins are gradually increasing in the transition area in axial direction and/or the curvature of the S-shaped contact structures increases in the transition area toward the center of the contact section. Such an arrangement provides for a gradual transition from the guide section to the contact section while providing in the transition area already the same basic spring properties as in the contact section.

The S-shaped spring arms are preferably so formed that their cross-sections increase parabolically toward the apeces of the structures. Such parabolic increase in cross-section is derived from an application of calculations for cantilevered support arms with constant bending strain; it defines a cross-section which provides for equal bending strain of the spring arms over their full length. Such a shape provides for even and optimal strain of the material used for the manufacture of the contact pins. On the other hand the cross-section of the S-shaped spring arms may be made about constant over their full extent if their manufacture is more economical in this manner.

For proper dimensioning of the S-shaped spring arms it is pointd out that there should always be a small space between the outer surfaces of the S-shaped arms and the inner surface of the contact bore up to the desired point of contact between the contact arms and the contact bore even in the smallest possible contact bore area. This is necessary not only in order to maintain the desired spring characteristics but it also provides for relatively long spring travel paths and smooth spring support for the contact areas of the contact pins.

The contact surface areas of the end portions of these S-shaped contact structures are so selected as to have only relatively small engagement areas in order to achieve a relatively high specific surface pressure or relatively large engagement areas with a relatively small specific surface pressure on the contact metal layers of the contact bores. It is particularly advantageous if the contact structures are so formed that the contact area at the outer side of the S-shaped contact arms with the contact bore surface between a minimum and maximum diameter area follows a slight spiral having a generating point extending between the minimum and maximum bore diameters. Depending on the desired specific surface contact pressure or depending on the material utilized, such a spiral may be a logarithmic spiral or an Archimedes spiral. In any case, the arrangement provides for sufficient contact area between the contact arms and the coated contact bore walls that the contact members do not penetrate the contact material layers and yet provide for a good sufficiently large area of contact engagement without gases between the contact surfaces. Preferably, the contact surface areas on the contact arms should be somewhat curved which can be achieved by curving the ends of the contact arms slightly inwardly.

In order to achieve appropriate centering of the contact pins in the contact bores, the S-shaped contact structures are preferably symmetric with respect to the contact pin center line.

It is finally pointed out that such contact pins can be easily manufactured if in accordance with the invention the contact section of the pin of an originally circular or profiled cross-section is first formed to a flat profile of essentially oblong cross-section preferably with somewhat bent-over edges from which profile the desired S-shaped cross-section is then stamped. Between the various forming steps there may be annealing steps in order to provide always for the same material working conditions. It is noted that such contact pins can easily be manufactured in a fully automatic fashion from wire stock of circular or profiled cross-section.

SHORT DESCRIPTION OF THE DRAWINGS

DESCRIPTION OF THE EMBODIMENTS

Figures 1, 1A, 1B, 1C:
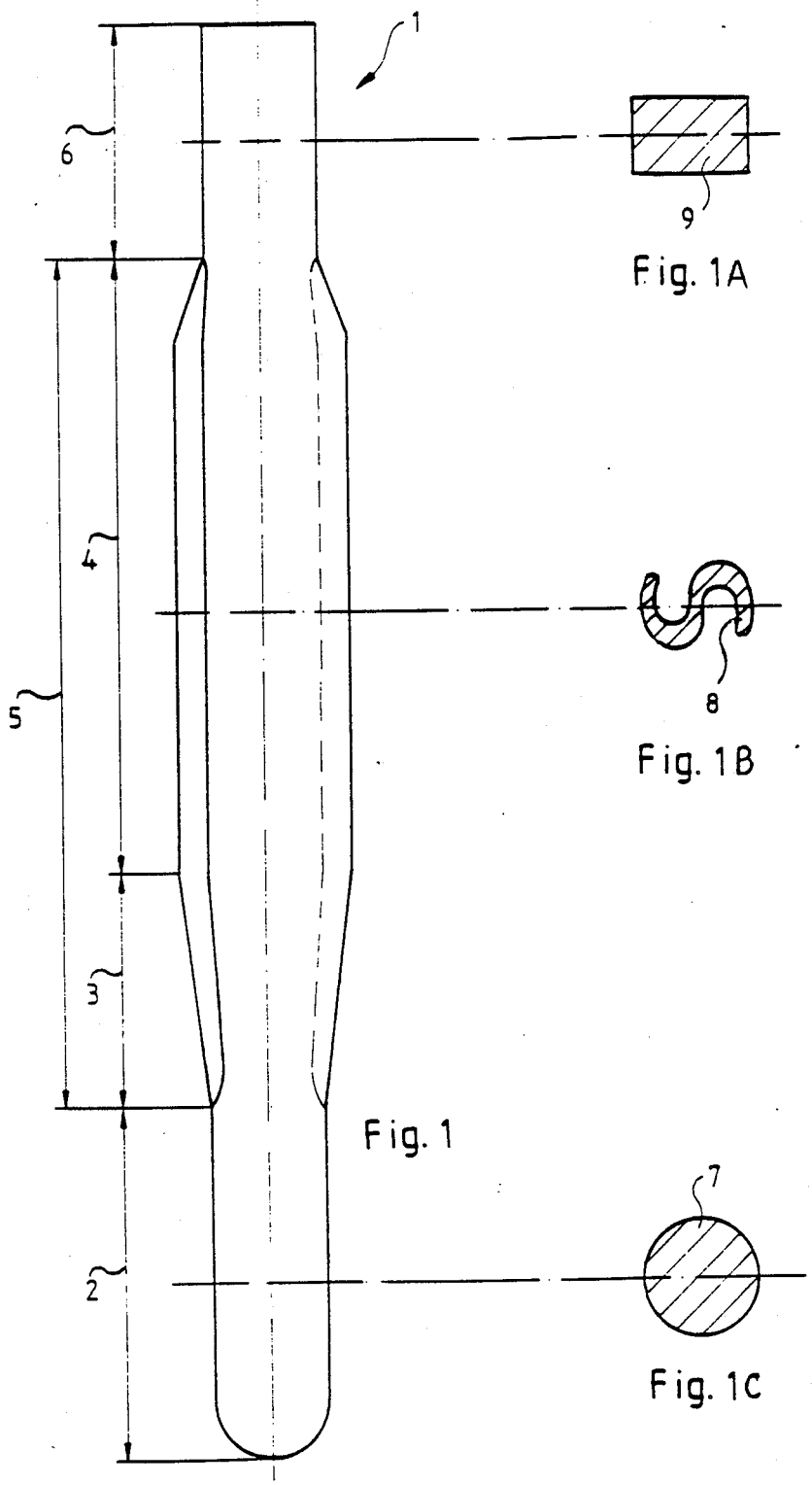
FIG. 1 is a side view of a contact pin giving its cross-section at various places along its length (FIG. 1A, FIG. 1B, FIG. 1C)

The contact pin (1) as shown in FIG. 1 may be divided into four sections:

1. The guide section 2,
2. the transition section 3,
3. the main contact section 4 which together with the transition section 3 forms the total contact section 4, and
4. the connection section 6.

FIGS. 1A, FIG. 1B and FIG. 1C represent the cross-section of the pin 1 in the given areas: A circular cross-section 7 is shown for the guide section 2 of the pin 1 (FIG. 1C), an S-shaped cross-section 8 is shown for the contact section 5 of the pin 1 (FIG. 1B) and an oblong cross-section 9 is shown for the connection section 6 of the pin 1 (FIG. 1A).

Figure 2:
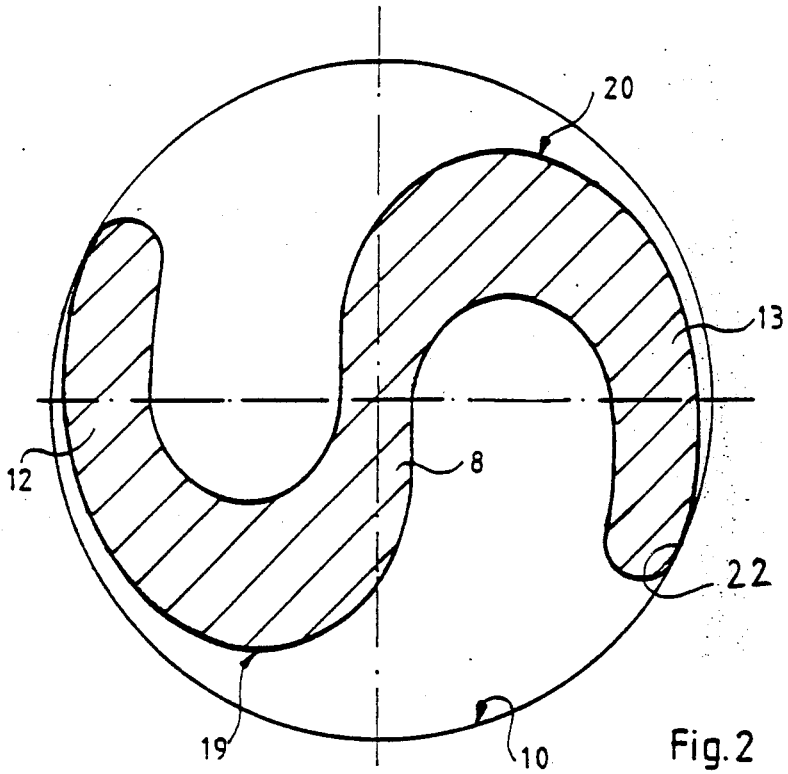
FIG. 2 shows the cross-section of the contact structure in a relatively large bore area (tolerance maximum)
Figure 3:
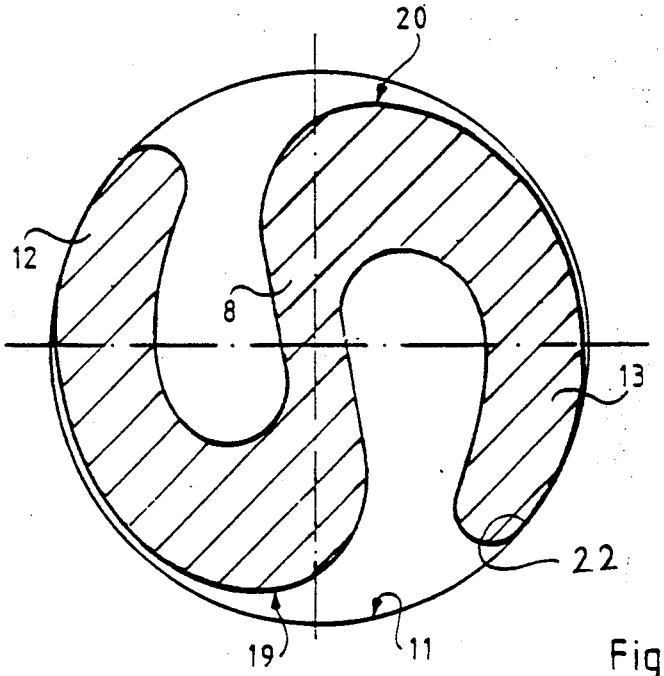
FIG. 3 shows the cross-section of the contact structure in a relatively small bore area (tolerance minimum)

The S-shaped cross-section 8 is again shown in FIGS. 2 and 3; in FIG. 2 it is shown in a relatively large area of the contact bore 10 (at tolerance maximum) and in FIG. 3 it is shown in a relatively small bore area 11 (at tolerance minimum). Both of the S-shaped contact arms 12 and 13 are disposed in the bores 10 and 11 symmetrically. They are especially shaped such that they abut the inner surface of the bores 10, 11 with a predetermined specific pressure. For full utilization of the structural material, that is, to provide full spring capabilities, the cross-section of the S-shaped spring arms 12, 13 increases parabolically toward the vertices 19 and 20.

FIGS. 2 and 3 clearly demonstrate the large spring range of such a contact pin with S-shaped cross-sectional spring arms 12, 13: The spring arms so formed are of substantial length; they extend after the full diameter of the bore, that is, they have maximum length for the given conditions. Therefore the spring arm contact areas 21, 22 remain safely engaged in contact with the contact layers on the walls of the contact bores even if the bores or bore areas are relatively large, that is, at maximum tolerance size. At the same time the contact pressure is not excessive, that is, the contact layers in the contact bores are not subjected to excessive contact pressures if the contact bore area is relatively small, for example, at minimum tolerance diameter. Both S-shaped contact arms of the contact pin 1 have identical spring characteristics so that the contact pin 1 is always centered in the contact bores 10, 11.

Figure 4:
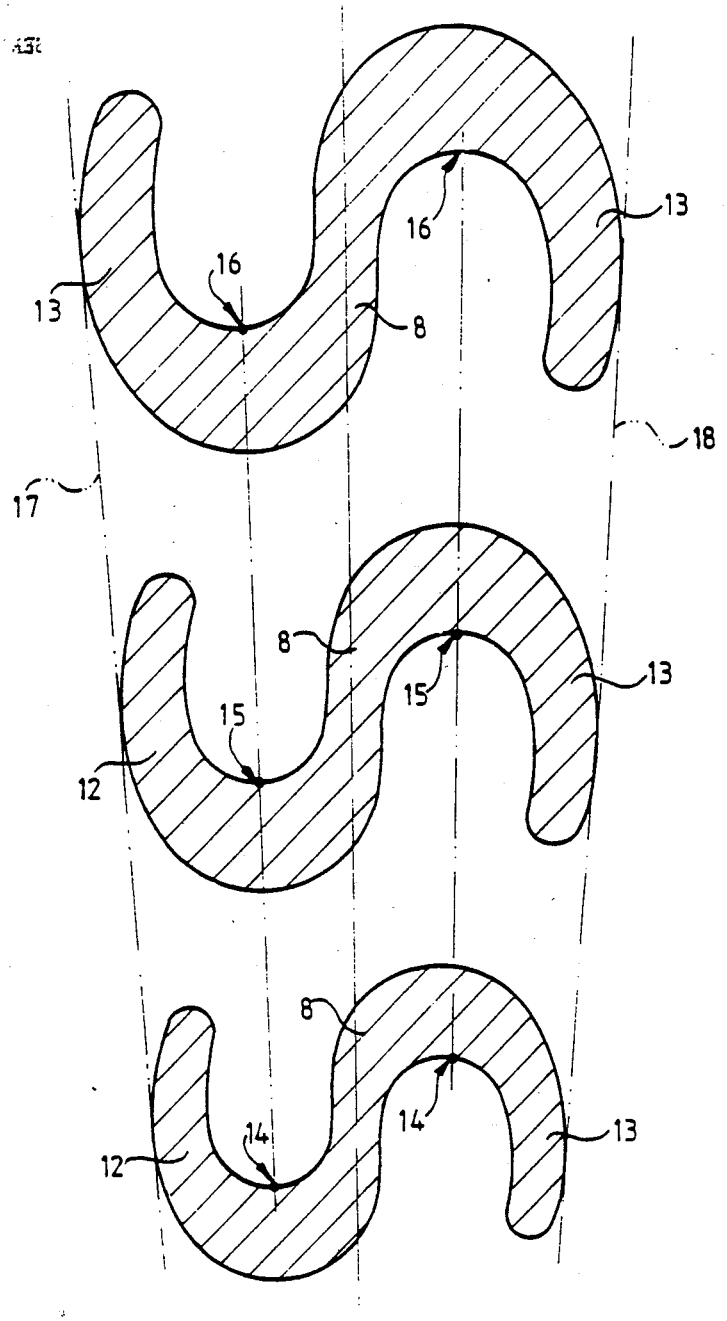
FIG. 4 shows the contact structure cross-sections in a transitional area.

FIG. 4 shows schematically the transition area 3 with the contact arms 12 and 13 with inner vertices 14, 15 and 16 in the different cross-sectional bore areas which extend outwardly with growing bore cross-section while the curvature of the S-shaped arms increases toward their outer ends. This, of course, also increases the outer diameter of the contact surface areas as is indicated in FIG. 4 by the dash-dotted lines 17, 18.

What is claimed is:

1. A contact pin for insertion into metal-coated bores of contact panels, said pin consisting of a leading guide section, an axially subsequent contact section and a connecting section, said contact section being S-shaped in cross-section thereby providing opposite curved radial spring arms with contact surface areas at the radial ends of the arms adapted to provide predetermined specific contact surface pressures over the full axial length of the contact section, said S-shaped spring arms having vertices between the center line of the pin and the outer ends of the arms and the cross-section of said arms being largest at said vertices.

2. A contact pin according to claim 1, wherein the S-shaped contact arms have essentially a constant cross-section over the full axial length of said contact section.

3. A contact pin according to claim 1, wherein the cross-section of said arms increases parabolically toward said vertices.

4. A contact pin according to claim 1, wherein the outer ends of said spring arms are slightly curved inwardly.

5. A contact pin according to claim 1, wherein said spring arms are so formed that between their contact surface areas and the outer vertices of the spring arms their outer surfaces are disposed at small distances from the bore surface thereby providing for maximum resiliency of the spring arms.

6. A contact pin according to claim 1, wherein said spring arms are arranged symmetrically with respect to the axis of the pin.

7. A contact pin according to claim 1, wherein the vertices at the inner sides of the S-shaped arms are gradually extending outwardly in the trasition area between the guide section and the contact section of the pin and wherein the curvature of the S-shaped arms increases in the transition section from the guide section toward the contact section.

* * * * *